United States Patent [19]

Sugi

[11] 4,369,749

[45] Jan. 25, 1983

[54] VARIABLE VENTURI CARBURETOR

[75] Inventor: Fumio Sugi, Handa, Japan

[73] Assignee: Aisan Kogyo Kabushiki Kaisha, Japan

[21] Appl. No.: 228,898

[22] Filed: Jan. 27, 1981

[51] Int. Cl.[3] ..... F02M 7/00

[52] U.S. Cl. ..... 123/439; 261/44 C; 261/121 B; 261/DIG. 81

[58] Field of Search ..... 123/440, 438, 439; 261/44 C, 121 B, DIG. 81, 121 A

[56] References Cited

U.S. PATENT DOCUMENTS

| | | | |
|---|---|---|---|
| 2,752,136 | 6/1956 | Gardner | 261/DIG. 67 |
| 4,091,781 | 5/1978 | Mituyasu | 123/440 |
| 4,110,417 | 8/1978 | Konishi et al. | 261/44 C X |

FOREIGN PATENT DOCUMENTS

| | | | |
|---|---|---|---|
| 54-132024 | 10/1979 | Japan | 123/440 |
| 55-37578 | 3/1980 | Japan | 261/DIG. 81 |

*Primary Examiner*—Tony M. Argenbright

*Attorney, Agent, or Firm*—Blair, Brown & Kreten

[57] ABSTRACT

Disclosed herein is an improvement in a variable venturi carburetor for an internal combustion engine which comprises a venturi portion, a float chamber, a main fuel passage communicating with the venturi portion and with the float chamber, a main fuel jet provided in the main fuel passage and a movable metering needle. A free end of the metering needle is adapted to control the size of the main fuel jet and the base portion of the metering needle is mounted to a suction piston adapted to transversely move with respect to the venturi portion in response to the condition of load on the internal combustion engine. The improvement includes provision of a bypass detouring upwardly from a portion of the main fuel passage upstream of the main fuel jet for discharging vapor of fuel, and the bypass communicates with a negative pressure passage which has an opening in the lower portion of the venturi portion and with an air passage which has an opening in the vicinity of an air horn inlet.

5 Claims, 2 Drawing Figures

VARIABLE VENTURI CARBURETOR

BACKGROUND OF THE INVENTION

1. Field of the Invention

The present invention relates to a variable venturi carburetor for an internal combustion engine (hereinafter referred to as "engine") which can supply fuel at appropriate air-fuel ratio regardless of changes in the temperature of the fuel by utilizing constant negative pressure of the venturi portion.

2. Description of the Prior Art

In a conventional variable venturi carburetor for an engine, the fuel is caused to evaporate as the temperature thereof rises, leading to generation of bubbles of vapor in the fuel liquid. When the fuel containing such bubbles reaches a main fuel jet, the bubbles stay in an annular clearance between the main fuel jet and a metering needle to prevent normal flowing of the fuel since the area of the clearance is small. On account of this, the fuel cannot be supplied to the engine under appropriate air-fuel ratio, leading to a bad condition such as stoppage of the engine.

Further, during idling of the engine in which the volume of intake air is small, the area of the annular clearance between the main fuel jet and the metering needle becomes remarkably small, and especially when the temperature of the fuel is low, the flow of the fuel is decreased by viscosity, leading to inappropriate air-fuel ratio of the fuel to be supplied to the engine. Still further, it is difficult to obtain increased flow of the fuel for starting of the engine which requires an enriched mixture.

SUMMARY OF THE INVENTION

It is an object of the present invention to provide a variable venturi carburetor for an internal combustion engine which can supply fuel at appropriate air-fuel ratio when the temperature of the fuel is high without leaving bubbles of vapor of the fuel in a main fuel jet.

It is another object of the present invention to provide a variable venturi carburetor for an internal combustion engine which can supply fuel at appropriate air-fuel ratio required for idling of the engine when the temperature of the fuel is low.

It is still another object of the present invention to provide a variable venturi carburetor for an internal combustion engine which can increase flow of fuel for supplying an enriched mixture required for starting of the engine.

According to the present invention, there is provided a variable venturi carburetor which has a bypass detouring a main fuel metering portion and communicating with a negative pressure passage having an opening in the lower portion of a venturi portion and with an air passage having an opening in the vicinity of an air horn inlet so that bubbles of vapor in high temperature fuel are discharged through the bypass and metering of the main fuel can be correctly maintained thereby supplying the fuel to the engine in appropriate air-fuel ratio.

The variable venturi carburetor according to the present invention further has a means for closing the air passage or controlling the volume of air flowing therein to supply constant flow of fuel from the bypass to the engine independently of the fuel flowing through the main fuel metering portion thereby enabling increase of flow of the fuel for obtaining an enriched mixture required for starting of the engine or an appropriate mixture required for idling of the engine when the temperature of the fuel is low.

DESCRIPTION OF THE PREFERRED EMBODIMENTS

Figure 1:
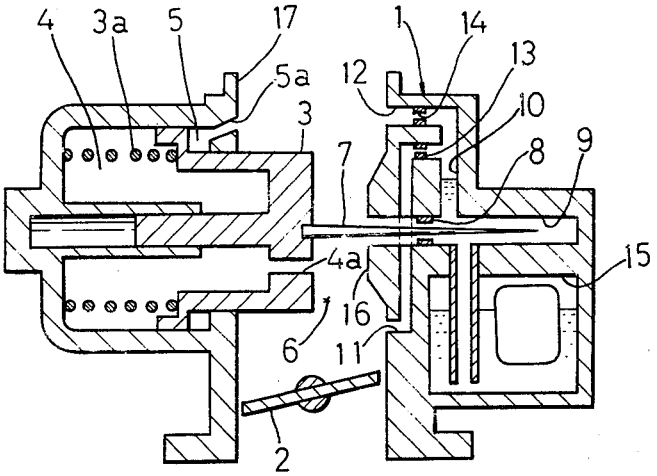
FIG. 1 is a longitudinal front sectional view of an embodiment of the present invention.

Referring now to FIG. 1 of the drawings, a variable venturi carburetor 1 has a venturi portion 6 which comprises a throttle valve 2, a suction piston 3 and an air horn side wall 16. A suction chamber 4 comprises a cylinder provided in the carburetor 1 and the suction piston 3 which is slidable in contact with the inner wall surface of the cylinder. The suction chamber 4 contains therewithin a compression spring 3a which presses the suction piston 3 against the air horn side wall 16. In the bottom of the suction piston 3, there is provided a negative pressure vent 4a which makes the suction chamber 4 communicate with the venturi portion 6. An atmospheric chamber 5 is defined between the rear surface of the slidable flange of the suction piston 3 and the body of the carburetor 1, into which air is introduced through an air intake 5a formed in the vicinity of the inlet of an air horn 17. A metering needle 7 is mounted to the central portion of the bottom of the suction piston 3 facing the venturi portion 6, and the free end thereof is inserted into the interior of a main fuel jet 8 which is provided in the middle portion of a main fuel passage 9 formed in the upper portion of a float chamber 15 of the carburetor 1.

The main fuel passage 9 is provided in its portion upstream of the main fuel jet 8 with a bypass 10 which has an inlet in the upper portion of the passage 9 and communicates with a negative pressure passage 11 having an opening in the lower portion of the venturi portion 6 and with an air passage 12 having an opening in the vicinity of the inlet of the air horn 17. The negative pressure passage 11 and the air passage 12 have a negative pressure jet 13 and an air jet 14 respectively in junctions with the bypass 10.

Figure 2:
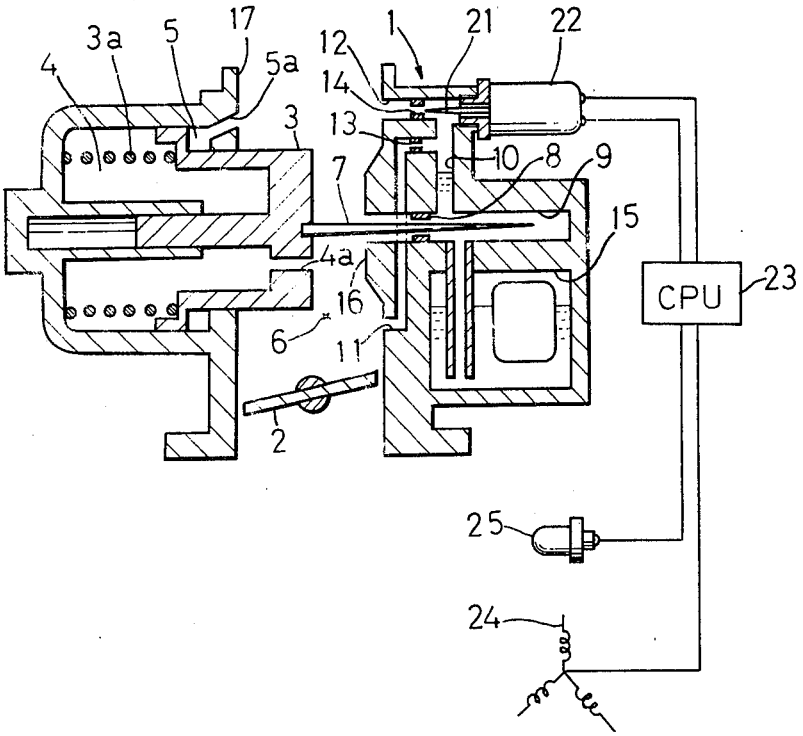
FIG. 2 is a longitudinal front sectional view of another embodiment of the present invention.

FIG. 2 shows a second embodiment of the present invention in which a needle valve 21 is provided for controlling the size of the air jet 14. The needle valve 21 is driven in the longitudinal direction by a switchgear 22 formed by an electromagnetic valve or an electric motor, for metering the volume of air. A controller 23 is further provided for controlling the switchgear 22 by a signal from an alternator 24 or a temperature sensor 25.

In the variable venturi carburetor of the first embodiment, the venturi portion 6 is maintained under constant negative pressure while the engine is driven. The main fuel is metered by the metering needle 7 and the main fuel jet 8 so as to continuously keep constant air-fuel ratio with respect to the volume of air sucked in response to opening of the throttle valve 2 corresponding to the engine load and is injected into the venturi portion 6.

However, as the temperature of the fuel in the float chamber 15 rises, the fuel is caused to evaporate and generates bubbles of vapor in the fuel liquid. The fuel liquid thus containing bubbles of vapor is then flown into the main fuel jet 8.

In this case, the constant negative pressure of the venturi portion 6 acting on the negative pressure passage 11 is utilized and throttling of the negative pressure jet 13 and the air jet 14 is appropriately adjusted so that the negative pressure of the bypass 10 is continuously maintained at a condition under which the fuel in the main fuel passage 9 will not flow into the negative pressure passage 11 and the air in the air passage 12 will not flow backward into the main fuel passage 9.

By virtue of this, the bubbles of vapor in the fuel flowing toward the main fuel jet 8 are absorbed in the bypass 10 without remaining in the interior of the main fuel jet 8 since they are lighter than the fuel, and discharged downwardly of the venturi portion 6 through the negative pressure passage 11. Consequently, the main fuel jet 8 can correctly meter the flow of the fuel.

In the second embodiment as shown in FIG. 2, the flow of the fuel is increased independently of the main fuel metered in the main fuel jet 8 by utilizing the fact that when the air passage 12 is closed, constant flow of fuel is continuously sucked out downwardly of the venturi portion 6 through the bypass 10 and the negative pressure passage 11 by virtue of the constant negative pressure of the venturi portion 6 acting on the negative pressure passage 11. Namely, upon receiving a signal from the alternator 24 detecting starting of the engine or the temperature sensor 25 detecting idling of the engine at a low temperature, the controller 23 controls the switchgear 22 to drive the needle valve 21 for closing the air jet 14. Consequently, the negative pressure of the venturi portion 6 alone acts on the bypass 10 through the negative pressure passage 11 so that the bypass 10 sucks the fuel in the main fuel passage 9 and supplies the same to the venturi portion 6 in constant flow.

Increased flow of fuel can thus be supplied for an enriched mixture which is necessary for starting of the engine and the negative pressure of the bypass 10 may be regulated by controlling driving of the needle valve 21 in accordance with the signal from the temperature sensor 25 to regulate the flow rate of the increased fuel which is necessary for idling of the engine at a low temperature.

While the invention has been described with reference to a few preferred embodiments thereof, it is to be understood that modifications or variations may be easily made without departing from the scope of this invention which is defined by the appended claims.

What is claimed is:

1. A structure in a variable venturi carburetor of an internal combustion engine for preventing fuel vapor bubbles to pass to a main fuel jet comprising: a venturi portion, a float chamber, a main fuel passage communicating with the venturi portion and with the float chamber, the main fuel jet provided in the main fuel passage and a movable metering needle, a free end of said metering needle being adapted to control the size of the main fuel jet and a base portion of said metering needle being mounted to a suction piston adapted to transversely move with respect to the venturi portion in response to the condition of load on the internal combustion engine, an improvement including provision of a bypass detouring upwardly from a portion of the main fuel passage upstream of the main fuel jet for discharging the vapor of fuel, said bypass communicating with a negative pressure passage having an opening in a lower portion of said venturi portion and said bypass communicating also with an air passage having an opening in the vicinity of an air horn inlet.

2. The invention as defined in claim 1 wherein said negative pressure passage and said air passage have a negative pressure jet and an air jet respectively dimensioned to keep a portion of liquid fuel standing in said bypass.

3. The invention as defined in claim 2 wherein said air passage is provided with a switchgear having a needle valve for controlling the size of said air jet.

4. The invention as defined in claim 3 wherein said switch gear is operatively conditioned by an engine temperature sensor.

5. The invention as defined in claim 3 wherein said switch gear is operatively conditioned by an alternator means adapted to detect an engine when starting.

* * * * *